US005529164A

United States Patent [19]

Meinke et al.

[11] Patent Number: 5,529,164

[45] Date of Patent: Jun. 25, 1996

[54] APPARATUS FOR TRANSPORTING ROD-SHAPED ARTICLES

[75] Inventors: Karsten Meinke, Hamburg; Andreas Rinke, Bad Oldesloe, both of Germany

[73] Assignee: Hauni Maschinenbau AG, Hamburg, Germany

[21] Appl. No.: 335,544

[22] Filed: Nov. 7, 1994

[30] Foreign Application Priority Data

Dec. 17, 1993 [DE] Germany ..... 43 43 134.8

[51] Int. Cl.[6] ..... B65G 1/00

[52] U.S. Cl. ..... 198/347.2

[58] Field of Search ..... 198/347.2, 347.3

[56] References Cited

U.S. PATENT DOCUMENTS

| | | | |
|---|---|---|---|
| 4,316,754 | 2/1982 | Hinchcliffe et al. . | |
| 4,339,026 | 7/1982 | Bäse et al. | 198/347.2 |
| 4,507,040 | 3/1985 | Baese et al. | 198/347.2 X |
| 4,717,009 | 1/1988 | Carter et al. . | |
| 4,744,453 | 5/1988 | Krause et al. | 198/347.2 |
| 4,795,020 | 1/1989 | Carter et al. . | |
| 4,865,179 | 9/1989 | Carter | 198/347.2 |
| 5,147,022 | 9/1992 | Raschka | 198/347.2 |
| 5,217,101 | 6/1993 | Raschka | 198/347.2 |

*Primary Examiner*—James R. Bidwell
*Attorney, Agent, or Firm*—Darby & Darby

[57] ABSTRACT

Cigarettes or other rod-shaped articles of the tobacco processing industry are transported sideways from a source along an elongated horizontal path into at least one downwardly extending second path. If the inlet of a second path is to be sealed from the adjacent outlet portion of the horizontal path, a partition is moved across the inlet in the general direction of advancement of articles along the first path. The partition includes a carrier which is reciprocable along a slightly upwardly and forwardly inclined track, and a flexible belt which is tensioned by one or more springs and is trained over the leader of the carrier. A variable-capacity reservoir is located above the horizontal path opposite the inlet of each second path to accept some of the articles which are being moved back into the first path in response to movement of the partition across the inlet of the adjacent second path. A rotary member is installed adjacent the leader of the partition when the latter seals the inlet of the corresponding second path to thus further reduce the likelihood of damage to articles as a result of movement of the partition from its retracted position across the inlet of the respective second path.

18 Claims, 2 Drawing Sheets

APPARATUS FOR TRANSPORTING ROD-SHAPED ARTICLES

BACKGROUND OF THE INVENTION

The invention relates to improvements in apparatus for transporting rod-shaped articles, and more particularly to improvements in apparatus which can be utilized with advantage to transport rod-shaped articles of the tobacco processing industry between one or more first stations (each of which can accommodate a maker of rod-shaped articles) and one or more processing machines for rod-shaped articles. Still more particularly, the invention relates to improvements in apparatus for transporting a mass flow of rod-shaped articles (particularly plain or filter cigarettes, cigars, cigarillos or cheroots and/or filter rod sections) between at least one maker and at least one processing machine in such a way that the articles are advanced sideways, i.e., at least substantially at right angles to their longitudinal axes.

It is known to advance a mass flow of rod-shaped articles of the tobacco processing industry (hereinafter called cigarettes or filter cigarettes for short) along a first path which extends from one or more makers and into one or more second paths which branch off the first path and serve for advancement of cigarettes to one or more processing machines, e.g., from one or more filter tipping machines which turn out filter cigarettes to one or more packing machines for arrays or groups of filter cigarettes. Each second path defines with the adjacent portion of the first path a substantially T-shaped junction which permits a certain number of arriving cigarettes to advance beyond the inlet of the respective second path and causes or permits the other articles to enter the inlet of the respective second path. Each second path can serve for the transport of a mass flow of cigarettes to a tray filling machine (e.g., a machine known as HCF 80 and distributed by the assignee of the present application), to a packing machine (e.g., a machine known as COMPAS 500 and distributed by the assignee of the present application) or another processing machine.

Problems arise when one or more processing machines are brought to a halt or are caused to process the arriving cigarettes at a rate less than an optimum rate. It is then necessary to reduce the rate of or to interrupt the advancement of cigarettes from the first path into the respective second path. The need to reduce the rate of or to interrupt the advancement of cigarettes into a processing machine can arise for a number of reasons, for example, due to malfunctioning of the processing machine, due to defects of cigarettes in the first path and/or for many other reasons. Heretofore known systems for reducing or interrupting the rate of advancement of a mass flow of cigarettes from a first path into one or more second paths are not entirely satisfactory because they are likely to affect the quality (e.g., the shape and/or the appearance) of the articles which happen to be located at a junction between the first path and a second path. Certain articles are likely to stagnate at a blocked junction and thus undergo damage as a result of contact with articles which advance beyond the blocked junction. In addition, the articles which continue to advance beyond the blocked junction are likely to be damaged by the articles which gather at such junction as a result of interruption of the advancement of articles from one or more sources to the respective processing machine or machines.

OBJECTS OF THE INVENTION

An object of the invention is to provide an apparatus which can transport a mass flow of rod-shaped articles from one or more first stations (e.g., from one or more cigarette makers or filter tipping machines) to one or more second stations in such a way that the quality of articles is not affected as a result of interruptions of the advancement of articles from a first path into one or more second paths leading to one or more processing machines (e.g., cigarette packing or tray filling machines).

Another object of the invention is to provide an apparatus which embodies novel and improved means for gentle treatment of rod-shaped articles at one or more junctions between a first path for a mass flow of articles and one or more second paths which branch off the first path and must be sealed from the first path when the need arises, e.g., in response to malfunctioning of a processing machine.

A further object of the invention is to provide an apparatus which ensures that the sealing of one or more second paths from the adjacent portion(s) of the first path does not entail any damage to the articles which advance beyond the inlet or inlets of one or more sealed second paths.

An additional object of the invention isto provide an apparatus which can be incorporated in existing production lines for rod-shaped articles of the tobacco processing industry as a superior substitute for heretofore known apparatus serving to divide a first mass flow of articles into two or more flows.

Still another object of the invention is to provide the apparatus with novel and improved means for blocking the entry of rod-shaped articles from a first path into one or more second paths.

A further object of the invention is to provide an apparatus which can be utilized with particular advantage for the transport of plain or filter cigarettes from one or more makers to one or more processing machines, for example, from a cigarette maker or filter tipping machine to two or more packing or tray filling machines.

Another object of the invention is to provide a novel and improved reservoir which can be utilized in the above outlined apparatus to temporarily accept certain numbers of articles during and immediately after blocking of the flow of articles from a first path into a second path.

An additional object of the invention is to provide a novel and improved method of transporting mass flows of cigarettes or other rod-shaped articles of the tobacco processing industry from one or more first stations to one or more second stations.

Still another object of the invention is to provide a production line which embodies one or more transporting apparatus of the above outlined character.

A further object of the invention is to provide novel and improved article transporting units which can be utilized in the above outlined apparatus.

Another object of the invention is to provide an apparatus which can automatically respond to interruptions and/or reductions of the requirements of one or more processing machines for plain or filter cigarettes, cigars, cigarillos or cheroots and/or filter mouthpieces.

SUMMARY OF THE INVENTION

The invention is embodied in an apparatus for transporting rod-shaped articles of the tobacco processing industry (such as plain or filter cigarettes, cigars, cigarillos, cheroots and/or filter rod sections) from at least one first station (e.g., a station accommodating one or more makers of cigarettes or other rod-shaped articles of the tobacco processing industry) to at least one second station (e.g., to a station accommodating a tray filling or packing or other article processing machine). The improved apparatus comprises a first transporting unit defining an elongated first path for the advancement of a mass flow of articles sideways (i.e., at least substantially at right angles to their longitudinal axes) from the at least one first station in a first direction, a second transporting unit which defines a second path having an inlet normally communicating with an outlet portion of the first path to advance articles from the first path in a second direction toward the at least one second station, and means for temporarily blocking (when necessary) the advancement of articles from the outlet portion of the first path into the inlet of the second path. The means for temporarily blocking comprises at least one partition which is movable substantially transversely of the second direction between a first position in which the inlet is at least substantially sealed from the outlet portion of the first path and a second position in which the inlet is free to receive articles from the outlet portion of the first path.

The apparatus can be constructed, assembled and oriented in such a way that the first path is at least substantially horizontal, at least in the region of its outlet portion, and that the second path extends downwardly from the outlet portion of the first path.

The first path can extend in the first direction beyond its outlet portion (i.e., beyond the inlet of the second path), and the inlet of the second path and the outlet portion of the first path can define a substantially T-shaped junction wherein the articles advance only in the first direction in the first position of the at least one partition and wherein the articles advance in the first and second directions in the second position of the at least one partition.

The second transporting unit can include a duct in which the second path extends downwardly from the outlet portion of the first path, and the means for blocking can further comprise means for moving the at least one partition substantially in the first direction in order to advance the at least one partition from the second position to the first position. The means for moving preferably further comprises means for moving the at least one partition at least substantially counter to the first direction in order to advance the partition from the first position to the second position. The duct is preferably assembled and oriented in such a way that it includes a first wall having an opening for the at least one partition and a second wall downstream of the first wall (as seen in the first direction). The at least one partition is close to the second wall in the first position of the at least one partition and remote from the second wall in the second position of the at least one partition.

The moving means of the blocking means can comprise means for moving the at least one partition along an upwardly sloping path from the second position toward the first position of the at least one partition.

The at least one partition can include a carrier (e.g., a panel or a plate) which is movable relative to the first and second walls of the duct substantially in and counter to the first direction between the first and second positions, and at least one flexible band (e.g., a sheet or belt) having a first portion affixed to the first wall of the duct, a second portion affixed to one end of an expandible and contractible resilient element (e.g., a coil spring), and an intermediate portion disposed between the first and second portions and being trained over a portion of the carrier. The carrier can include a leader which is respectively adjacent to and remote from the second wall in the first and second positions of the at least one partition, and the intermediate portion of the at least one band is then trained over the leader of the carrier. The extent of movability of the carrier can be such that its leader is adjacent the first wall in the second position of the at least one partition.

The first or the second transporting unit (e.g., the first transporting unit) can include a rotary member (e.g., an elongated roller, pulley or sheave) which is adjacent the second wall of the duct downstream of the inlet (as seen in the first direction). The transporting unit which includes the rotary member can further comprise at least one endless flexible element (e.g., a belt or, band of textile or other suitable material) which is trained over the rotary member and has a reach contacting the articles in the adjacent portion of the respective path.

The inlet of the second path is disposed at one side of the first path, and the apparatus can further comprise a variable-capacity reservoir (e.g., a first-in last-out reservoir) for rod-shaped articles at the other side of the first path at least substantially opposite the inlet of the second path. The reservoir can comprise at least one mobile support for a flexible membrane which is interposed between the at least one support and the outlet portion of the first path. It is presently preferred to construct the reservoir in such a way that it comprises two pivotable supports (e.g., in the form of flaps) and that the membrane is interposed between the outlet portion of the first path and the pivotable supports. The arrangement can be such that the supports are pivotable about substantially parallel axes which are adjacent each other and extend transversely of the first direction in substantial parallelism with the longitudinal axes of the rod-shaped articles in the first and/or in the second path. The supports include first portions which are adjacent the respective axes and second portions which are spaced apart from each other in the first direction. The membrane of such reservoir is affixed to the second portions of the supports.

The moving means of the means for blocking is preferably constructed and assembled to move the carrier of the at least one partition relative to the second transporting unit along an elongated third path to thereby move the at least one partition between the first and second positions. Such means for blocking can further comprise at least one track and the means for moving can include a prime mover (e.g., a fluid-operated motor) which serves to advance the carrier along the at least one track.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawings.

DESCRIPTION OF PREFERRED EMBODIMENTS

Figure 1:
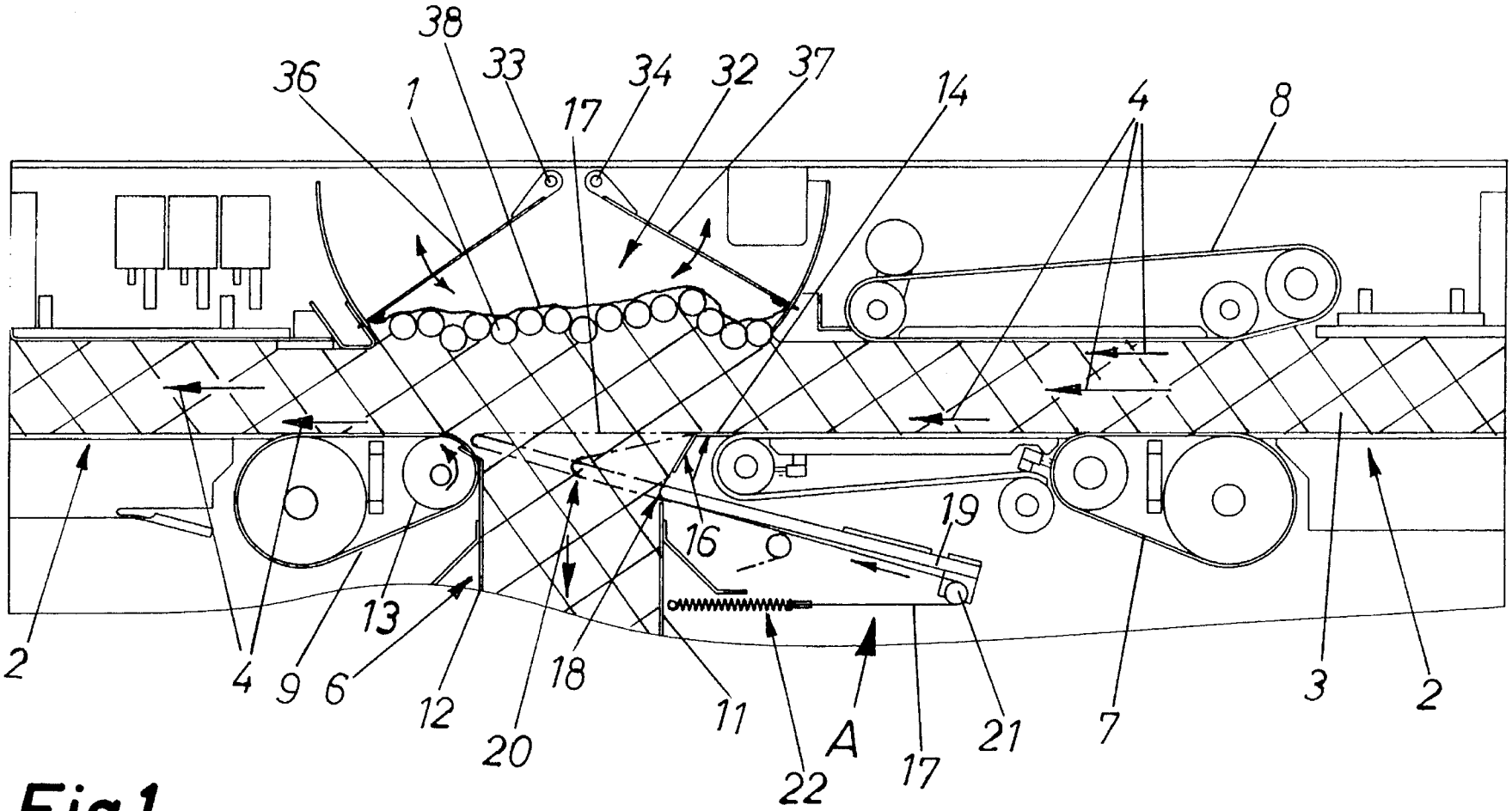
FIG. 1 is a fragmentary schematic elevational view of an article transporting apparatus which embodies one form of the present invention.

Referring first to FIG. 1, there is shown an apparatus which serves to transport rod-shaped articles 1 of the tobacco processing industry (e.g., cigarettes) from a first station (located to the right of FIG. 1) to one or more second stations (e.g., to a packing machine disposed at a level below FIG. 1 and/or to a magazine located to the left of FIG. 1). Reference may be had, for example, to commonly owned U.S. Pat. No. 4,339,026 granted Jul. 13, 1982 to Horst Bäse et al. for "Apparatus for delivering cigarettes or the like from a maker to a consuming machine" which describes and shows an apparatus adapted to transport cigarettes from a maker to a packing machine and/or to a first-in last-out magazine. The disclosure of the patent to Bäse et al. is incorporated herein by reference.

The apparatus of FIG. 1 comprises a first transporting unit which defines an elongated substantially horizontal first path 2 for a mass flow 3 of rod-shaped articles 1 in the direction indicated by the arrows 4 from one or more makers (e.g., a filter cigarette production line of the type known as PROTOS 70 and including a rod maker known as SE 70 cooperating with a filter assembler known as MAX 70, all produced and distributed by the assignee of the present application). The articles 1 in the path 2 are oriented in such a way that their longitudinal axes extend transversely of the direction indicated by the arrows 4, i.e., the articles are advanced sideways. The mass flow 3 can contain two or more superimposed layers of parallel articles 1.

The first transporting unit includes several endless belt conveyor assemblies including the endless belts 7, 8 and 9, the associated pulleys, sheaves or analogous rotary members (one shown at 13) and several walls (not referenced but shown in FIG. 1). The path 2 has an outlet portion immediately to the right of the rotary member 13 which permits certain articles 1 of the mass flow 3 to enter the inlet or intake end of a second elongated path 6 which extends downwardly from the level of the adjacent outlet portion of the path 2. The path 6 is defined by a second transporting unit including a duct having walls 11 and 12. The wall 12 is located downstream of the wall 11, as viewed in the direction of the arrows 4, and the path 6 can but need not be exactly normal to the adjacent outlet portion of the path 2. The duct including the walls 11 and 12 normally delivers a mass flow of articles to a processing machine at the second station, e.g., to a cigarette packing machine.

As can be seen in FIG. 1, the first path 2 extends beyond the inlet of the second path 6 to deliver a certain portion of the mass flow 3 to at least one additional second station (e.g., to one or more additional packing machines) and/or into storage (such as the aforementioned first-in last-out magazine or reservoir).

The articles 1 which enter the duct 6 are also caused to advance sideways, i.e., at least substantially at right angles to the direction indicated by the arrows 4, on their way to the magazine of the packing machine at the second station. The inlet of the second path 6 and the adjacent outlet portion of the first path 2 define a substantially T-shaped junction wherein the mass flow 3 is normally divided into a first stream advancing downwardly in the path 6 and a second stream advancing beyond the inlet of the path 6 on its way toward one or more additional processing (e.g., packing) machines and/or into a magazine or reservoir. Reference may be had again to the aforementioned patent to Bäse et al. The inclination of the duct including the walls 11 and 12 is such that the articles 1 entering the path 6 can descend therein by gravity flow.

In accordance with a feature of the invention, the apparatus of FIG. 1 further comprises a unit 20 constituting a means for temporarily blocking the advancement of articles 1 from the outlet portion of the path 2 into the inlet of the path 6. The blocking unit comprises a mobile partition including a substantially plate-like or panel-like carrier 19 and an elongated flexible band 17, a resilient element 22 (here shown as a coil spring) and means for moving the carrier 19 in and counter to the direction indicated by the arrows 4. The directions in which the carrier 19 of the partition further including the flexible band 17 is movable back and forth are normal to the direction of advancement of articles 1 in the path 6 and substantially parallel to the direction indicated by the arrows 4. In the apparatus of FIG. 1, the plane of the carrier 19 makes a relatively small acute angle with the direction of advancement of articles 1 along the path 2. The carrier 19 is movable between a first position (shown in FIG. 1 by phantom lines) in which its leader 18 is closely adjacent the rotary member 13 and a second position (shown in FIG. 1 by solid lines) in which the leader 18 is located in or close to an opening or window of the wall 11, and through one or more intermediate positions one of which is shown in FIG. 1 by phantom lines.

One end portion of the resilient element 22 is affixed to the wall 11 or to another stationary part of the apparatus, and the other end portion of the element 22 is affixed to one end of the flexible band 17. The latter is trained over a pulley or sheave 21 of the carrier 19 as well as over the leader 18 of the carrier, and its other end is secured to the substantially horizontal part 14 of the substantially inverted V-shaped upper portion 16 of the wall 11. The part 14 can be said to constitute one wall of the transporting unit which defines the elongated path 2. The illustrated one-piece carrier 19 extends across the entire path 6 (as seen at right angles to the plane of FIG. 1). However, it is equally within the purview of the invention to employ two or more narrower carriers 19 as well as to employ two or more narrower belts 17. The leader 18 preferably constitutes a suitably rounded foremost portion of the carrier 19 so that the adjacent portion of the belt 17 can readily slide along such leader when the carrier 19 is caused to move along the slightly upwardly sloping path between its first position (inlet of the path 6 sealed from the outlet portion of the path 2) and its second position (the leader 18 located in or close to the opening in the wall 11 of the duct defining the path 6). The resilient element 22 ensures that the belt 17 is adequately tensioned in each position of the carrier 19 relative to the walls 11 and 12.

Figure 2:
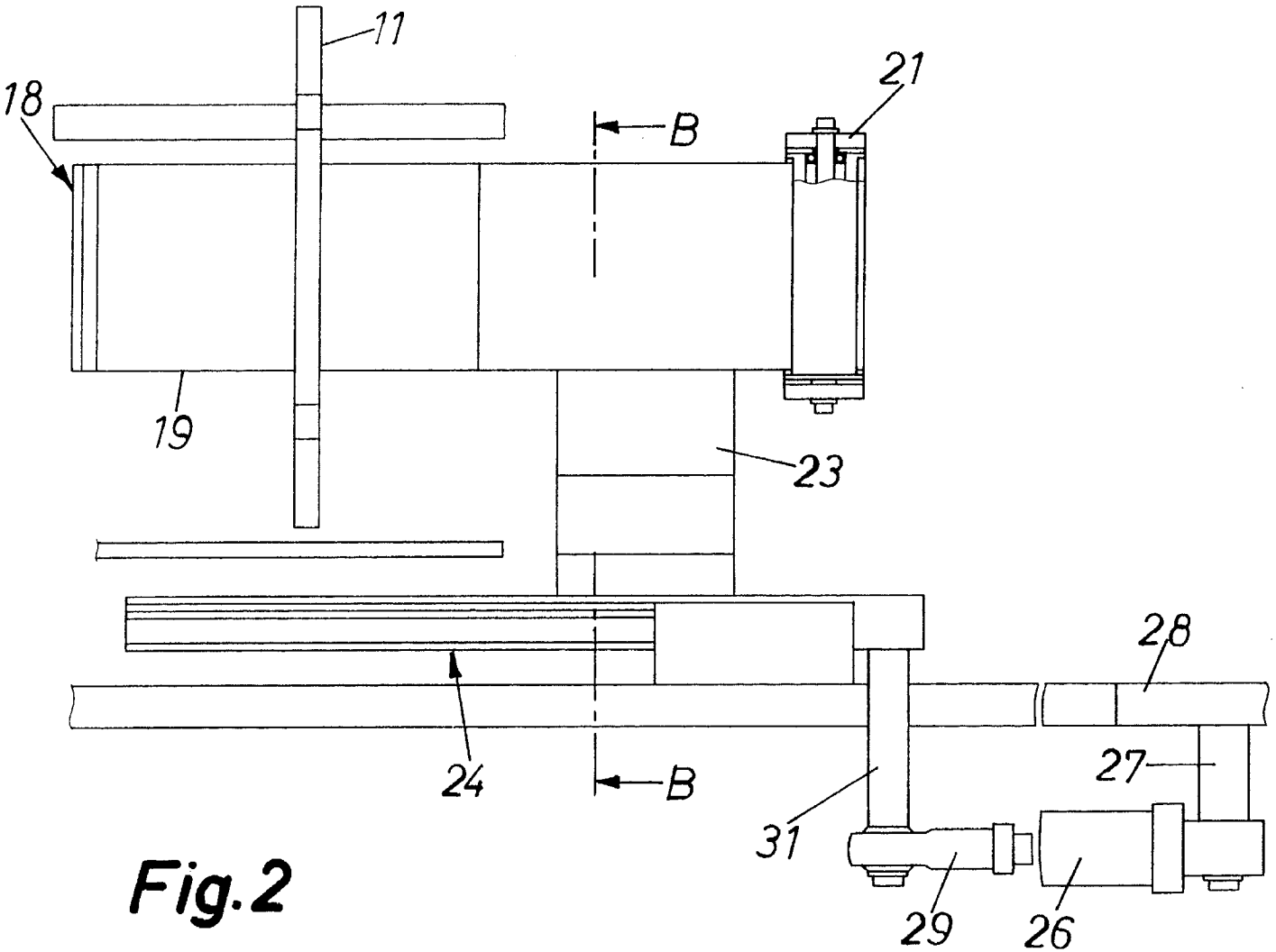
FIG. 2 is an enlarged bottom plan view of the structure at the junction of a first path with a second path for rod-shaped articles, substantially as seen in the direction of arrow A in FIG. 1.
Figure 3:
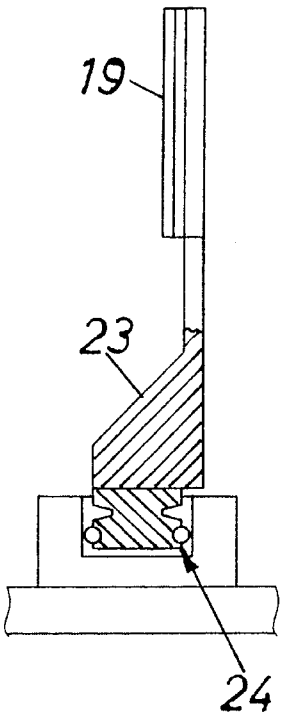
FIG. 3 is a fragmentary sectional view substantially as seen in the direction of arrows from the line B—B in FIG. 2.

The blocking unit 20 further comprises an elongated straight track 24 which defines the slightly sloping elongated path for a carriage 23 mounting the carrier 19 for movement between its first and second positions. The track 24 is shown in FIGS. 2 and 3, and the FIG. 2 further shows the means for moving the carrier 19 along the carrier 24. Such moving means comprises a prime mover 26, e.g., a double-acting fluid-operated (such as pneumatic) motor 26 having a piston rod 29 connected to the carriage 23 by a motion transmitting member 31. The cylinder of the double-acting motor 26 is pivotably connected to a wall 28 by a crosshead 28. The wall 28 constitutes or can constitute a component of the housing of the improved apparatus.

In accordance with another feature of the invention, the improved apparatus further comprises a variable-capacity reservoir 32 which is installed at the outlet portion of the first path 2 opposite the inlet of the second path 6. The capacity of the reservoir 32 varies in automatic response to movements of the partition including the carrier 19 and the belt 17 between its first and second positions. The illustrated reservoir 32 includes two plate-like supports or flaps 36, 37 mounted on pivots 33, 34 having axes parallel to each other and to the axes of articles 1 in the path 2. The pivots 33, 34 are closely adjacent each other and pivotably mount the adjacent end portions of the respective supports 36 and 37. The other end portions of the supports 36, 37 are spaced apart from each other (as seen in the direction indicated by the arrows 4) and are connected with the respective end portions of a flexible membrane 38 which overlies the adjacent articles 1 of the mass flow 3 in the path 2. The membrane 38 can include a plurality of articulately connected links and is disposed between the supports 36, 37 and the adjacent articles 1 of the mass flow 3.

The construction of the blocking unit or units (if any) which is or which are installed downstream of the duct including the walls 11, 12 is or can be identical with that of the blocking unit 20. The same applies for the additional variable-capacity reservoir (or reservoirs) 32 (if any).

The operation of the apparatus which is shown in FIGS. 1 to 3 is as follows:

When the machine at the station beneath the duct including the walls 11 and 12 operates at a normal speed and the machine or machines delivering articles 1 into the path 2 also operate at a normal speed, the partition including the carrier 19 and the belt 17 is maintained in the solid-line (second) position so that the T-shaped junction including the inlet of the path 6 and the adjacent outlet portion of the path 2 ensures the delivery of a predetermined quantity of articles 1 per unit of time to the magazine of the machine at the discharge end of the path 6. In other words, the blocking unit 20 is then idle and its partition including the parts 17, 19 does not or need not interfere with the admission of articles 1 into the path 6. The suitably shaped (preferably rounded) leader 18 of the carrier 19 is then located in the opening of the wall 11. This not only ensures a predictable rate of delivery of articles 1 to the machine receiving articles from the path 6 but also ensures that (if the rate of admission of articles 1 into the path 2 is constant) the machine or machines receiving articles from the path 2 downstream of the wall 12 also receive rod-shaped articles at a predictable rate. As mentioned above, the articles 1 advancing beyond the wall 12 can be delivered to one or more additional packing machines and/or to one or more reservoirs and/or to one or more other processing machines.

If the machine receiving articles 1 from the path 6 fails to operate in a desired manner or is arrested for any other reason, the prime mover 26 is set in motion (either by an operator or by an actuator in automatic response to detection of stoppage or malfunctioning of the machine receiving articles from the path 6) so that the carrier 19 is moved by the carriage 23 along the track 24, i.e., along a preferably slightly upwardly sloping path toward the rotary member 13 for the belt 9. The belt 17 is moved in the same direction by the leader 18 of the moving carrier 19, i.e., the spring 22 is caused to store energy or to store additional energy. The purpose of the partition including the carrier 19 and the belt 17 is to prevent (or to at least reduce the likelihood of) damage to articles 1 which are caused to advance across the inlet of the path 6 when the leader 18 of the carrier is closely or immediately adjacent that portion of the belt 9 which is trained over the rotary member 13.

As the leader 18 of the carrier 19 advances along the slightly upwardly sloping path (determined by the track 24) from the opening in the wall 11 toward the upper end portion of the wall 12, the belt 17 gently raises the articles 1 at the inlet of the path 6 back into the adjacent outlet portion of the path 2, i.e., back into the mass flow 3 in the path 2. The articles in the upper stratum or strata of the mass flow 3 engage the flexible membrane 38 of the variable-capacity reservoir 32 to thus further reduce the likelihood of damage to the articles in the mass flow 3 as a result of sealing of the inlet of the path 6 from the adjacent outlet portion of the path 2. The articles 1 above the sealed inlet of the path 6 can merely deform the membrane 38 or, if necessary, cause the supports or flaps 36, 37 to pivot in opposite directions about the axes of the respective pivot members 33, 34 in order to further increase the capacity of the reservoir 32.

The rotary member 13 cooperates with the belt 17 and with the membrane 38 to even further reduce the likelihood of damage to articles 1 in the adjacent portion of the path 2. Thus, the rotary member 13 is immediately adjacent the upper end portion of the wall 12 and is driven in a counterclockwise direction (as viewed in FIG. 1) to advance the adjacent portion of the belt 9 in the direction of the arrows 4. Such movement of the belt 9 greatly reduces the likelihood of jamming of articles 1 above the sealed inlet of the path 6. Thus, the rotary member 13 and the belt 9 cooperate with the belt 17 to eliminate (or at least greatly reduce) the likelihood of deformation, squashing, pinching and/or other damage to the articles 1 which are adjacent the inlet of the path 6 at the time when the prime mover 26 is on to move the leader 18 of the carrier 19 from the opening in the wall 11 toward the rotary member 13.

The feature that the carrier 19 is advanced in the general direction indicated by the arrows 4 while its leader moves from the opening in the wall 11 toward the rotary member 13 adjacent the upper end portion of the wall 12 also contributes to gentle treatment of articles 1 in the adjacent portion of the mass flow 3 and contributes to gentle lifting of some of the articles 1 into the variable-capacity reservoir 32. All this contributes to desirable smooth transition from delivery of articles 1 into the path 6 and one or more additional second paths to delivery of articles only into the path or paths downstream of the wall 12.

The relatively thin leader 18 of the carrier 19 exhibits the advantage that it can cause the adjacent portion of the belt 17 to readily penetrate into and to advance across the inlet of the path 6 when the prime mover 26 is actuated (either by hand or automatically) in order to seal the inlet of the path 6 from the adjacent outlet portion of the path 2. If desired, the leader 18 of the carrier 19 can support a single small-diameter roller or a row of coaxial small-diameter rollers to thus eliminate friction between the belt 17 and the carrier 19.

The rotary member 13 and the adjacent portion of the belt 9 can be said to form part of the first transporting unit which defines the path 2 and/or of the second transporting unit which defines the path 6.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art and, therefore, such adaptations should and are intended to be comprehended within the meaning and range of equivalence of the appended claims.

What is claimed is:

1. Apparatus for transporting rod-shaped articles of the tobacco processing industry from at least one first station to at least one second station, comprising a first transporting unit defining an elongated first path for the advancement of a mass flow of articles sideways from the at least one first station in a first direction; a second transporting unit defining a second path having an inlet normally communicating with an outlet portion of said first path to advance articles from the first path in a second direction toward the at least one second station; and means for temporarily blocking the advancement of articles from said outlet portion into said inlet, including at least one partition movable substantially transversely of said second direction between a first position in which said inlet is at least substantially sealed and a second position in which said inlet is free to receive articles from said outlet portion, said means for blocking further including means for moving said at least one partition along an upwardly sloping path from said second position toward said first position.

2. The apparatus of claim 1, wherein said first path is substantially horizontal at least in the region of said outlet portion and said second path extends downwardly from said outlet portion.

3. The apparatus of claim 1, wherein said first path extends in said first direction beyond said outlet portion thereof, said inlet and said outlet portion defining a substantially T-shaped junction wherein the articles advance only in said first direction in the first position and wherein the articles advance in said first and second directions in the second position of said at least one partition.

4. The apparatus of claim 1, wherein said second transporting unit includes a duct in which said second path extends downwardly from said outlet portion of said first path, said means for moving comprising means for moving said at least one partition substantially in said first direction during movement of said at least one partition along said upwardly sloping path from said second to said first position thereof.

5. The apparatus of claim 4, wherein said means for moving further comprises means for moving said at least one partition substantially counter to said first direction from said first to said second position thereof.

6. The apparatus of claim 5, wherein said duct includes a first wall having an opening for said at least one partition and a second wall downstream of said first wall, as seen in said first direction, said at least one partition being respectively close to and remote from said second wall in said first and second positions thereof.

7. The apparatus of claim 1, wherein said second transporting unit comprises a duct extending downwardly from said outlet portion and having a first wall and a second wall located downstream of said first wall, as seen in said first direction, said at least one partition including a carrier movable relative to said walls substantially in and counter to said first direction between said first and second positions and at least one flexible band having a first portion affixed to said first wall, a second portion affixed to a resilient element, and an intermediate portion disposed between said first and second portions and being trained over a portion of said carrier.

8. The apparatus of claim 7, wherein said carrier portion includes a leader which is respectively adjacent and remote from said second wall in the first and second positions of said at least one partition, said intermediate portion of said at least one band being trained over said leader of said carrier.

9. The apparatus of claim 8, wherein said leader of said carrier is adjacent said first wall in the second position of said at least one partition.

10. The apparatus of claim 1, wherein said second transporting unit includes a first wall and a second wall downstream of said first wall, as seen in said first direction, one of said units comprising a rotary member adjacent said second wall downstream of said inlet as seen in said first direction.

11. The apparatus of claim 10, wherein said one transporting unit further comprises at least one endless flexible element trained over said rotary member.

12. The apparatus of claim 1, wherein said inlet is disposed at one side of said first path and further comprising a variable-capacity reservoir for rod-shaped articles at the other side of said first path at least substantially opposite said inlet.

13. The apparatus of claim 12, wherein said reservoir comprises at least one mobile support for a flexible membrane interposed between said support and said outlet portion of said first path.

14. The apparatus of claim 12, wherein said reservoir comprises two pivotable supports and a flexible membrane interposed between said supports and said outlet portion of said first path.

15. The apparatus of claim 14, wherein said supports are pivotable about substantially parallel axes adjacent each other and extending transversely of said first direction in substantial parallelism with the articles in at least one of said paths, said supports including first portions adjacent the respective axes and second portions spaced apart from each other in said first direction, said membrane being affixed to the second portions of said supports.

16. The apparatus of claim 1, wherein said third path is elongated.

17. The apparatus of claim 1, wherein said means for blocking further comprises a track and said means for moving includes a prime mover arranged to advance a carrier of said at least one partition along said track.

18. The apparatus of claim 17, wherein said prime mover includes a fluid-operated motor.

* * * * *